United States Patent [19]

Nishimura et al.

[11] Patent Number: 4,710,432

[45] Date of Patent: Dec. 1, 1987

[54] BASE MATERIAL FOR HONEYCOMB CORE STRUCTURE AND PROCESS FOR PRODUCING THE SAME

[75] Inventors: Kunio Nishimura; Tadashi Hirakawa, both of Ibaraki, Japan

[73] Assignee: Teijin Limited, Osaka, Japan

[21] Appl. No.: 865,210

[22] Filed: May 19, 1986

[30] Foreign Application Priority Data

Aug. 8, 1985 [JP] Japan ..... 60-173108

[51] Int. Cl.[4] ..... B32B 3/12

[52] U.S. Cl. ..... 428/542.8; 162/157.3; 428/116; 428/288; 428/296

[58] Field of Search ..... 428/116, 118, 288, 296, 428/542.8; 162/157.3

[56] References Cited

U.S. PATENT DOCUMENTS

| | | | |
|---|---|---|---|
| 3,223,581 | 12/1965 | Sommer et al. | 428/397 X |
| 3,309,260 | 3/1967 | Boese | 428/296 X |
| 3,933,589 | 1/1976 | Keyes | 435/177 X |
| 4,155,792 | 5/1979 | Gelhaar et al. | 428/118 X |
| 4,307,768 | 12/1981 | Anderson | 428/116 X |
| 4,496,583 | 1/1985 | Yamamoto et al. | 428/288 |
| 4,520,124 | 5/1985 | Abe et al. | 156/89 X |
| 4,569,884 | 2/1986 | Weinand et al. | 428/265 X |
| 4,621,020 | 11/1986 | Tashiro et al. | 162/157.3 X |

FOREIGN PATENT DOCUMENTS

| | | | |
|---|---|---|---|
| 39-07640 | 5/1964 | Japan | 428/116 |
| 53-129267 | 11/1978 | Japan | 428/116 |
| 53-134075 | 11/1978 | Japan | 428/116 |
| 1595300 | 8/1981 | United Kingdom | 428/224 |

*Primary Examiner*—Henry F. Epstein

*Attorney, Agent, or Firm*—Burgess, Ryan & Wayne

[57] ABSTRACT

A base material for a honeycomb core structure comprises a paper-like polyester fiber sheet comprising 20% to 80% by weight of drawn polyester staple fibers which preferably have a flat cross-sectional profile having a flatness, which refers to a ratio in length of a major axis to a minor axis of the profile, of from 2.5 to 30.0, 20% to 80% by weight of the sum of undrawn polyester staple fibers and other polyester staple fibers having a lower melting point than that of the undrawn polyester fibers, and having a porosity of 60% or less and a resistance to permeation of air of 100 sec/100 ml or more.

8 Claims, No Drawings

BASE MATERIAL FOR HONEYCOMB CORE STRUCTURE AND PROCESS FOR PRODUCING THE SAME

BACKGROUND OF THE INVENTION

1. Field of the Invention

The present invention relate to a base material for a honeycomb core structure having an excellent resistance to corrosion, water and moisture, and which is light weight.

More particularly, the present invention relates to a base material having not only an excellent resistance to corrosion, water and moisture, but also a superior mechanical strength, heat resistance, and property preventing a strike-through phenomenon of a resin material, for example, an adhesive, and having a light weight and being useful for various types of honeycomb core structures in portions of aircraft, parts of cars, construction and building materials, parts of ships, parts of drawing boards, parts of skis, air flow-regulating boards of open showcases, air flow-regulating boards of spinning chimneys, louver materials of illumination units, and shock absorber materials of pressing machines.

2. Description of the Related Arts

Conventional honeycomb core structures have been made from base materials consisting of aluminum foil or kraft paper. For example, a honeycomb core structures made from an aluminum foil has a high mechanical strength and has been used for a part of an aircraft. However, for such a part of an aircraft, it has been required that the weight should be significantly reduced and the reliability in mechanical strength should be enhanced. Therefore, development of a honeycomb core structure having a further reduced weight and a further enhanced mechanical strength has been desired.

Also, various types of honeycomb core structures made from a base material consisting of kraft paper have been generally used for various purposes. However, the kraft paper honeycomb core structures are disadvantageous in that they have an unsatisfactory mechanical strength, a large change in dimension in wet conditions, and a low resistance to corrosion, though the weight is satisfactorily light.

As a base material for a honeycomb core structure having a light weight and a high thermalstability, a paper-like sheet made from aromatic polyamide fibers and pulp particles (Trademark: Nomex Paper, made by Du Pont) is known. The paper-like sheet is produced from a mixture of poly-m-phenylene isophthalamide staple fibers and pulp particles by means of a wet papermaking procedure. Since, however, the paperlike aromatic polyamide sheet is expensive, this type of honeycomb core structure is now utilized only for special purposes, for example, for aircraft parts, and has not yet been applied in a broad scope of industry.

SUMMARY OF THE INVENTION

An object of the present invention is to provide a base material for a honeycomb core structure having not only a light weight and a high mechanical strength, but also an excellent resistance to heat, moisture, water, and corrosion and being low-cost, and a process for producing the same.

The above-mentioned object is attained by the base material for a honeycomb core structure of the present invention, which comprises a paper-like polyester fiber sheet comprising 20% to 80% by weight of drawn polyester staple fibers, 0 to 80% by weight of undrawn polyester staple fibers, and 0 to 80% by weight of polyester staple fibers having a lower melting point than that of the undrawn polyester staple fibers, and which sheet has a porosity of 60% or less and a resistance to permeation of air of 100 sec/100 ml or more.

The drawn polyester staple fibers preferably have a flat cross-sectional profile having a degree of flatness which refers to a ratio in length of a major axis to a minor axis of the profile of from 2.5 to 30.0.

The base material can be produced by the process of the present invention, which comprises, suspending 20% to 80% by weight of drawn polyester staple fibers, 0 to 80% by weight of undrawn polyester staple fibers and 0 to 80% by weight of polyester staple fibers having a lower melting point than that of the undrawn polyester staple fibers in water; forming a precursory paper-like sheet from the suspension by means of a wet papermaking method; and heat-pressing the precursory paper-like sheet to provide a paper-like polyester fiber sheet.

The drawn polyester staple fibers preferably have a flat cross-sectional profile having a degree of flatness which refers to a ratio in length of a major axis to a minor axis of the profile, or from 2.5 to 30.0.

DESCRIPTION OF THE PREFERRED EMBODIMENTS

In the present invention, the porosity of the paper-like sheet is determined from the weight, the thickness is determined by means of a Peacock thickness meter in accordance with Japanese Industrial Standard (JIS) P 8118 and the real specific gravity of the paper-like sheet in accordance with the following equation:

$$\text{Porosity (\%)} = \left(1 - \frac{W}{(T \times 10^4) \times D}\right) \times 100$$

wherein W represents a weight in g/m$^2$ of a paper-like sheet, T represents a thickness in cm of the sheet and D represents a specific gravity in g/cm$^3$ of the sheet.

Usually, the paper-like polyester fiber sheet of the present invention has a real specific gravity of 1.38.

The resistance of a paper-like sheet to permeation of air therethrough is measured in accordance with JIS P 8117 and is represented by an average time in seconds necessary for permeating air in a volume of 100 ml through a portion of the paper-like sheet in an area of 78.54 mm$^2$ under a pressure of 721.9 g/cm$^2$.

Generally, a honeycomb core structure is produced from a base material consisting of a plurality of paper-like sheets or metal foil by laminating the sheets or foil and by expanding the laminate into the form of a honeycomb core. For example, an adhesive is applied in the pattern of a plurality of stripes with interval corresponding to a desired form and dimension of cells in the honeycomb core structure onto a plurality of sheets in accordance with, for example, the manner described in Japanese Examined Patent Publication No. 39-7640 or Japanese Unexamined Patent Publication No. 53-134075 the adhesive-applied sheets are superimposed on each other in a predetermined order and in predetermined locations so that the adhesive stripes on the sheets are deviated a half pitch from each other, and the resultant laminate is hot pressed to adhere the sheets to each other and to provide an unexpanded honeycomb core structure. Then, the laminate is cut to a length of the desired core structure and is expanded in accordance with, for example, the manner described in Japanese Unexamined Patent Publication No. 53-129,267 to provide a honeycomb core structure. The resultant honeycomb core structure is coated or impregnated with a thermosetting resin and is heat-treated at an elevated temperature to provide a thermosetting resin-fixed honeycomb core structure.

In the preparation of the honeycomb core structure, the adhesive usually comprises, for example, an epoxy resin phenolic compound-formaldehyde resin, polyimide resin or polyamideimide resin. Also, the thermosetting resin for fixing the honeycomb core structure may be selected from, for example, epoxy resins, polyimide resins, polyamide-imide resins and phenolic compound-formaldehyde resins. The thermosetting resin may contain 15% by weight or less of an additive, selected from, for example, various types of stabilizers and flame retardants, unless the additive has an affect on the quality of the resultant paper-like sheet.

In the base material for the honeycomb core structure of the present invention, the paper-like polyester fiber sheet has a porosity of 60% or less, preferably 50% or less, more preferably from 5% to 40%, and exhibits an air permeation resistance of 100 sec/100 ml or more, preferably 200 sec/100 ml or more, still more preferably 600 sec/100 ml or more, and further preferably from $10^3$ to $10^6$ sec/100 ml.

If the porosity is more than 60% and the air permeation resistance is less than 100 sec/100 ml, the resultant paper-like sheet is provided with an excessively large number of pores which are connected to each other to form a passage extending from a surface of the sheet to the opposite surface of the sheet therethrough. Therefore, when the porous paper-like sheet is used to form a honeycomb core structure, an adhesive applied onto a surface of a paper-like sheet penetrates therethrough and oozes out from the opposite surface thereof due to the strike-through phenomenon of the adhesive. Accordingly, when the paper-like sheet laminate is hot pressed, portions of the sheet which should not be adhered are adhered to each other.

If the porosity is 60% or less and the air permeation resistance is less than 100 sec/100 ml, the number of the pores in the resultant paper-like sheet is not large. The pores in the paper-like sheet, however, are connected to each other to form a number of passages extending from a surface to the opposite surface of the sheet. Accordingly, in the preparation of the honeycomb core structure, the adhesive applied to a surface of the paper-like sheet oozes out from the opposite surface of the paper-like sheet with a high frequency. This phenomenon causes portions of the paper-like sheet which should not be adhered to be adhered to each other in the hot-pressing procedure. Also, a portion of the adhesive which penetrates into the inside of the paper-like sheet and sometimes oozes out from the sheet causes the resultant honeycomb core structure to be excessively hardened and to exhibit a reduced absorption of impact energy applied to the honeycomb core structure.

If the porosity is more than 60% and the air permeation resistance is 100 sec/100 ml or more, the resultant paper-like sheet contains a large number of pores. However, most of the pores are independent from each other and the number of passages extending from a surface to the opposite surface of the sheet is not large.

Accordingly, when an adhesive is applied to a surface of the paper-like sheet, the strike-through phenomenon of the adhesive occurs at a low frequency. Also, the undesirable penetration of the thermosetting resin into the inside of the paper-like sheet occurs at a low probability. The large porosity, however, causes the resultant paper-like sheet to exhibit a reduced mechanical strength and the resultant honeycomb core structure to exhibit an unsatisfactory compression strength.

In the paper-like polyester fiber sheet of the present invention, the polyester fiber comprises at least one member selected from polyester resins which are polycondensation products of a dicarboxylic acid component comprising at least one selected from aromatic dicarboxylic acids, for example, isophthalic acid, terephthalic acid, diphenyl dicarboxylic acids, and naphthalene dicarboxylic acids, aliphatic dicarboxylic acids, for example, adipic acid, sebacic acid, and decane dicarboxylic acid, and cycloaliphatic dicarboxylic acids, for example, hexahydroterephthalic acid, with a diol component comprising at least one member selected from aliphatic glycol compounds, for example, ethylene glycol, propylene glycol, trimethylene glycol, tetramethylene glycol, decamethylene glycol, diethylene glycol and 2,2-dimethylpropane diol, cycloaliphatic glycol compounds, for example, hexahydroxylylene glycol, aromatic glycol compounds, for example, xylylene glycol, and polyalkylene glycols, for example, polyethylene glycol.

The polyester resin may consist of a homopolyester resin or a copolyester resin which comprising two or more different dicarboxylic acid compounds and/or two or more different diol compounds.

Preferable polyester resins are polyethylene terephthalate, polytetramethylene terephthalate, polytrimethylene terephthalate and polyester elastomers disclosed by U.S. Pat. No. 3,763,109 U.S. Pat. No. 3,203,192, U.S. Pat. No. 3,651,014 and U.S. Pat. No. 3,766,146.

The polyester resin may contain a plasticizer for increasing the plasticity of the resin, and/or a thickener for increasing the viscosity of the resin. Also, the polyester resin may contain an additive which is usually added to synthetic polymer fibers, for example, light stabilizer, pigment, heat stabilizer, flame retardant, lubricant and delusterant.

The drawn polyester staple fibers usable for the base material of the present invention are preferably provided with a flat cross-sectional profile having a flatness, which refers to a ratio in length of a major axis to a minor axis of the profile, of from 2.5 to 30.0, more preferably from 3.5 to 30.0, still more preferably from 3.5 to 25.0.

When the flatness is less than 2.5, the pores formed in the resultant paper-like sheet sometimes have an undesirable shape and size which cause an adhesive or thermosetting resin applied to the paper-like sheet to undesirably penetrate into the inside of the paper-like sheet. Also, a small flatness of less than 2.5 sometimes causes the staple fibers to come into contact with each other at a too small contact area. This feature results in an unsatisfactory mechanical strength and modulus of the paper-like sheet and in a poor compression strength and impact-energy-absorption property of the resultant honeycomb core structure.

Otherwise, if the flatness is more than 30.0, the resultant staple fibers are sometimes easily entangled with each other and the resultant staple fiber masses are easily twisted, and therefore, exhibit a decreased freeness and a degraded paper-forming property. Also, the resultant paper-like sheet exhibits an unsatisfactory touch.

It is necessary that the amount of the drawn polyester staple fibers be in a range of from 20% to 80% based on the entire weight of the drawn, undrawn, and low melting point polyester staple fibers. If the amount of the drawn polyester staple fibers is more than 80% by weight, the amounts of the undrawn and/or low melting point polyester staple fibers which serve as a binder for the drawn flat fibers will be relatively small and, therefore, the resultant paper-like sheet exhibits a decreased mechanical strength and modulus and the resultant honeycomb core structure has a reduced compression strength.

If the drawn polyester staple fibers are in an amount of less than 20% by weight, the effect of the drawn flat polyester staple fibers contained in the resultant paper-like sheet becomes unsatisfactory.

That is, the resultant paper-like sheet exhibits an unsatisfactory property for preventing the strike-through phenomenon of an adhesive or thermosetting resin. Also, the small contact of the drawn polyester staple fibers results in a decreased mechanical strength, modulus and thermal stability in dimension of the resultant paperlike sheet.

When the drawn polyester staple fibers have a flat cross-sectional profile, the flat fibers can come into contact with each other and with other fibers in a large contact area. This large contact area is effective for reducing the porosity and for increasing the resistance to air permeation. These effects result in increases in the property for preventing a strike-through phenomenon of the adhesive or thermosetting resin and in the mechanical strength and modulus of the resultant paperlike sheet.

In the paper-like sheet of the present invention, the undrawn polyester staple fibers are in an amount of from 0 to 80% by weight and the low melting point polyester staple fibers are in an amount of 0 to 80% by weight. The sum of the amounts of the undrawn and low melting point polyester staple fibers is at least 20% by weight but not more than 80% by weight.

The undrawn and low melting point polyester staple fibers are effective as a binder for fuse-bonding the drawn flat polyester staple fibers. If the total amount of the binder fibers is more than 80% by weight, the resultant paper-like sheet exhibits an excessively high porosity, a low air permeation resistance, and a poor mechanical strength and modulus. If the total amount of the binder fibers is less than 20% by weight, the resultant paper-like sheet exhibits a poor mechanical strength and modulus.

The binder fibers may consist of only the undrawn polyester staple fibers, only the low melting point polyester staple fibers, or a mixture of the undrawn and low melting point polyester staple fibers.

The undrawn polyester staple fibers usable for the present invention refer to polyester staple fibers which have been produced only by a melt-spinning procedure but have not yet been drawn, and which exhibit a birefringence of 0.03 or less and have a melting point of from 200° C. to 280° C.

As long as the birefringence does not exceed 0.03, the undrawn polyester staple fibers may be undrawn, highly orientated polyester staple fibers produced by means of a high speed melt-spinning process.

The birefringence of the fibers is determined in α-bromonaphthalene by means of a polarizing microscope in which a sodium light source is used and a Berek compensator is inserted in an optical path of the microscope.

The low melting point polyester staple fibers usable for the present invention have a melting point lower, preferably at least 20° C. lower, than that of the undrawn polyester staple fibers, and usually comprise a copolyester comprising two or more dicarboxylic acid comonomers and/or two or more diol comonomers. Also, low melting point polyester staple fibers may be ordinary single phase fibers consisting of a uniform mixture of two or more different polyester resins, core-in-sheath type composite fibers, or bimetal type composite fibers.

Usually, the low melting point polyester staple fibers have a melting point of from 120° C. to 260° C. and can be melted or softened at a heat-pressing temperature applied to a precursory paper-like sheet.

Each of the drawn, undrawn and low melting point polyester staple fibers preferably has a denier of from 0.01 to 15, more preferably from 0.1 to 10, and a length of from 1 to 25 mm, more preferably from 3 to 20 mm.

If the denier of the staple fibers is less than 0.01, the resultant paper-like sheet exhibits a poor tear strength. If the denier of the staple fibers is more than 15, the resultant paper-like sheet sometimes exhibits a reduced tensile strength.

Also, if the length of the staple fibers is more than 25 mm, the resultant paper-like sheet sometimes has an unsatisfactory touch and the staple fibers in the paper-like sheet are sometimes orientated in the longitudinal direction thereof in an excessive high degree of orientation and, therefore, the paper-like sheet exhibits a reduced dimensional stability. If the length of the staple fibers is less than 1 mm, the resultant paper-like sheet sometimes exhibits very poor tensile strength and tear strength.

In the process of the present invention, 20% to 80% by weight of drawn flat polyester staple fibers having a flatness of from 2.5 to 20.0, 0 to 80% by weight of undrawn polyester staple fibers and 0 to 80% by weight of low melting point polyester staple fibers are mixed and are suspended in water.

The resultant aqueous suspension or slurry is subjected to a paper-like sheet-forming procedure by means of a wet paper-making method to provide a precursory paper-like sheet. The sheet-forming procedure may be carried out by using a cylinder paper machine, wire paper machine or short net paper machine.

The precursory paper-like sheet is heat-pressed to provide a paper-like sheet.

In the preparation of the aqueous suspension, it is preferable that a thickener, especially an anionic thickener is added to the aqueous suspension to increase the uniformity of dispersion of the staple fibers in water and to improve the touch and appearance of the resultant paper-like sheet.

The heat-pressing procedure can be carried out in a usual manner, for example, by means of a pair of heat-pressing rolls. Where the heat-pressing rolls are used, the precursory paper-like sheet is heat pressed preferably at a roll surface temperature of from 190° C. to 240° C., more preferably from 200° C. to 230° C., under a linear pressure of from 10 kg/cm or more, more preferably 50 kg/cm or more, for a procedure speed of 0.5 m/min or more, more preferably 3 m/min or more.

In the preparation of the aqueous suspension, an additional material consisting of at least one member selected from wood pulp, another pulp-like polymer particles, and inorganic particles, for example, mica, kaoline, and talc particles and glass flakes may be added in an amount of 50% or less based on the total weight of the drawn, undrawn and low melting point polyester staple fibers. The above-mentioned additional material is effective as an impregnant and filler for enhancing the density and mechanical strength of the resultant paper-like sheet to be used as a base material for a honeycomb core structure.

The heat-pressed paper-like sheet can be directly used as a base material for a honeycomb core structure. Otherwise, the heat-pressed paper-like sheet may be treated with a resinous finishing material.

The resinous finishing material is applied in an amount of from 2% to 50% based on the weight of the paper-like sheet.

The resinous finishing material comprises at least one member selected from polyhydrocarbon resins, for example, polyethylene, polybutene-1, and polystyrene; acrylic resins, for example, polyacrylic ester and polymethacrylic ester resins; polyester resins; cellulosic derivative resins, for example, nitrocellulose and cellulose acetate resins; rosin and its derivatives for example, rosin esters; ketone resins; alkyd resins; urea-formaldehyde resins; phenolic compound-formaldehyde resins; melamine-formaldehyde resins; epoxy resins and terpene resins.

When the resinous finishing material comprises two or more different resins, they should be compatible with each other. The resinous finishing material preferably has a high bonding property to the polyester staple fibers.

The resinous finishing material is usually applied in the state of a solution or emulsion to the paper-like sheet by means of a dipping, spraying or coating method, and is dried and finally cured at an elevated temperature.

The honeycomb core structure produced from the base material of the present invention has a lighter weight and a lighter compression modulus of elasticity (elastic recovery of compression) than those of an aluminum foil base material. Therefore, the honeycomb core structure comprising the paper-like sheet base material of the present invention is useful as a gas flow-regulating board having a high resistance to deformation when an impact is applied thereto. Also, the honeycomb core structure in accordance with the present invention has a higher mechanical strength, resistance to moisture, water, and corrosion, and dimensional stability than those of a conventional kraft paper honeycomb core structure.

Furthermore, the honeycomb core structure in accordance with the present invention exhibits a superior property for preventing a strike-through of resinous liquid material to that of a conventional aromatic polyamide fiber sheet honeycomb core structure.

The paper-like sheet of the present invention contains the specific flat polyester staple fibers and, therefore, has a dense sheet structure having a high air permeation resistance and exhibits an enhanced mechanical strength and modulus and a high resistance to a strike-through phenomenon of a resinous liquid material. Accordingly, the honeycomb core structure made from the specific paper-like sheet of the present invention has a high resistance to penetration of an adhesive or another resinous liquid material into the inside of the sheet. Because of this feature, the thermosetting resin coating will not cause the honeycomb core structure to become brittle.

The present invention will be further described in detail by the following examples and comparative examples.

In the examples and comparative examples, the porosity and air permeation resistance of a paper-like sheet were determined by the methods as described hereinabove. The real specific gravity of a polyester fiber sheet was 1.38.

The tensile strength of a paper-like sheet was measured in accordance with JIS P 8113 by using a constant speed stretching type universal tensile tester at a length of specimen of 50 mm, at a width of specimen of 15 mm, and at a stretching rate of 100%/min.

The modulus of a paper-like sheet was calculated and determined from a maximum gradient in an initial portion of a stress-strain curve obtained in the abovementioned tensile strength test.

The degree of strike-through of a resin through a paper-like sheet was determined in the following manner.

A resin solution of 10% by weight of a phenolformaldehyde resin (available under a trademark of PL-2215 and made by Gunei Kagaku Co.) in methyl alcohol in an amount of 1.6 g was dropped on an absorbent cotton mass in the form of a web.

A specimen of a paper-like sheet was superimposed on the absorbent cotton web, two sheets of filter paper (No. 2, made by Toyo Filler Paper Co.) were placed on the specimen, and then a sheet of release paper was placed on the filter paper sheets. The resultant laminate was pressed by a load of 8 pounds applied to the release paper sheet for 30 minutes.

An amount of the resin solution which penetrated through the paper-like sheet specimen and was absorbed by the filter paper sheets was measured and the degree of strike-through of the resin solution through the specimen was determined in accordance with the following equation.

$$\text{Strike-through (\%)} = \frac{W_2 - W_1}{1.6} \times 100$$

wherein $W_1$ represents an original dry weight in grams of the two filter paper sheets and $W_2$ represents a weight of the two filter paper sheet containing the absorbed resin solution.

EXAMPLES 1 TO 8 AND COMPARATIVE EXAMPLES 1 TO 12

In each of Examples 1 to 8 and Comparative Examples 1 to 12, an aqueous slurry was prepared from drawn polyethylene staple fibers having a denier of 1.5 and a length of 5 mm, undrawn polyethylene terephthalate staple fibers having a melting point of 260° C., a denier of 1.1, and a length of 5 mm, and low melting point polyethylene terephthalate copolymer staple fibers having a melting point of 220° C., a denier of 4.0, and a length of 5 mm, respectively, is the amounts as indicated in Table 1, and was converted to a precursory paper-like sheet by means of a cylinder paper machine. The precursory sheet was dried by means of a Yankee drier at a temperature of 120° C. A dried precursory sheet having a weight of 65 g/m$^2$ was obtained.

The precursory sheet was heat-pressed by means of a pair of heat-pressing rolls at a roll surface temperature of 220° C., under a linear pressure of 100 kg/cm, and at a procedure speed of 20 m/min, to provide a paper-like polyester fiber sheet.

In each of Examples 2, 3, 7, and 8 and Comparative Examples 3, 5, 8, and 10 to 12, the resultant paper-like sheet was immersed in a polyacrylic resin emulsion (available under a trademark of C-72, and produced by Rohm & Haas) and was squeezed by a pair of nip rolls to remove any excessive amount of the resin emulsion. The paper-like sheet with the resin emulsion was dried at a temperature of 130° C. for 2 minutes and then cured at a temperature of 150° C. for 1 minutes. The resultant sheet contained the polyacrylic resin in the amount as indicated in Table 1.

The resultant sheet also exhibited the properties as indicated in Table 1.

In Comparative Examples 2, 3, 7 and 8, the contents of the drawn polyester staple fibers were within the scope of from 80% to 20% by weight. However, the resultant paper-like sheets had a porosity of more than 60% and an air permeation resistance of less than 100 sec/100 ml and, therefore, exhibited a poor resistance to strike-through of the resin emulsion.

In Examples 2, 3, 7 and 8, the resin treatments were effective for decreasing the porosity of the resultant paper-like sheet and for enhancing the resistance of the resultant paper-like sheets to air permeation and strike-through of the resin emulsion.

In Examples 1 to 8, the resultant paper-like sheets exhibited a satisfactory tensile strength and strike-through resistance.

EXAMPLES 9 TO 24 AND COMPARATIVE EXAMPLES 13 TO 21

TABLE 1

| | | Content (wt %) | | | | Paper-like sheet | | | | |
|---|---|---|---|---|---|---|---|---|---|---|
| Example No. | | Drawn polyester staple fiber (1.5 d, 5 mm) | Undrawn polyester staple fiber (1.1 d, 5 mm) | Low melting point polyester staple fiber (4 d, 5 mm) | Amount of resin (wt %) | Porosity (%) | Resistance to permeation of air (sec/100 ml) | Tensile strength (kg/15 mm) Longitudinal | Tensile strength (kg/15 mm) Lateral | Resistance to strike-through |
| Comparative Example | 1 | 10 | 90 | 0 | 0 | 14.5 | 6400 | 3.5 | 1.6 | Good |
| Example | 1 | 20 | 80 | 0 | 0 | 19.8 | 4840 | 6.9 | 3.2 | " |
| Comparative | 2 | 80 | 20 | 0 | 0 | 62.6 | 1.5 | 10.8 | 5.3 | Unsatisfactory |
| Example | 3 | 80 | 20 | 0 | 10.5 | 60.5 | 91 | 11.2 | 5.3 | " |
| Example | 2 | 80 | 20 | 0 | 15.6 | 59.8 | 130 | 11.8 | 5.9 | Good |
| | 3 | 80 | 20 | 0 | 31.4 | 56.9 | 620 | 12.3 | 6.9 | " |
| Comparative | 4 | 90 | 10 | 0 | 0 | 64.5 | 1.2 | 4.4 | 2.8 | Unsatisfactory |
| Example | 5 | 90 | 10 | 0 | 45.3 | 63.2 | 570 | 7.1 | 4.5 | " |
| | 6 | 10 | 0 | 90 | 0 | 13.1 | 7310 | 2.9 | 1.3 | Good |
| Example | 4 | 20 | 0 | 80 | 0 | 19.6 | 4670 | 6.1 | 3.0 | " |
| | 5 | 20 | 40 | 40 | 0 | 20.1 | 4390 | 6.4 | 3.0 | " |
| | 6 | 50 | 25 | 25 | 0 | 30.2 | 850 | 12.3 | 7.3 | " |
| Comparative | 7 | 80 | 0 | 20 | 0 | 64.4 | 1.5 | 10.1 | 4.9 | Unsatisfactory |
| Example | 8 | 80 | 0 | 20 | 12.1 | 64.9 | 85 | 10.1 | 5.8 | " |
| Example | 7 | 80 | 0 | 20 | 16.5 | 58.5 | 112 | 12.2 | 6.2 | Good |
| | 8 | 80 | 0 | 20 | 35.7 | 55.7 | 615 | 11.1 | 6.1 | " |
| Comparative | 9 | 90 | 0 | 10 | 0 | 64.4 | 1.0 | 3.8 | 1.9 | Unsatisfactory |
| Example | 10 | 90 | 0 | 10 | 52.9 | 61.2 | 580 | 6.9 | 4.0 | " |
| | 11 | 90 | 5 | 5 | 25.9 | 41.3 | 98 | 5.1 | 3.0 | " |
| | 12 | 95 | 0 | 5 | 23.1 | 59.4 | 1.3 | 4.7 | 2.7 | " |

Table 1 shows that the paper-like sheets of Comparative Examples 1, 4 to 6 and 9 to 12, in which the contents of the drawn polyester staple fibers fall outside of the scope of from 20% to 80% by weight, had unsatisfactory tensile strengths. The tensile strength of the paper-like sheet could be increased by applying a treatment with a resin thereto, as indicated in Comparative Example 5, 8 and 10 to 12, but the resin-applied paper-like sheets of Comparative Example 5, 8 and 10 to 12 exhibited a poor resistance to strike-through of the resin emulsion.

In each of Examples 9 to 24, and Comparative Examples 13 to 21, the same procedures as those described in Example 1 were carried out except that the drawn polyester staple fibers were replaced by drawn flat polyethylene terephthalate staple fibers having a flatness of 1.0 to 32.0, as shown in Table 2, a denier of 1.5 and a length of 5 mm, and in the amount as shown in Table 2, and the undrawn and low melting point polyester staple fibers were used respectively in the amounts as indicated in Table 2.

The resultant paper-like sheet exhibited the properties as shown in Table 2.

TABLE 2

| | | Content (wt %) | | | | Paper-like sheet | | | | |
|---|---|---|---|---|---|---|---|---|---|---|
| Example No. | | Drawn polyester staple fiber (1.5 d, 5 mm) Flatness | Drawn polyester staple fiber (1.5 d, 5 mm) Content (wt %) | Undrawn polyester staple fiber (1.1 d, 5 mm) | Low melting point polyester staple fiber (4 d, 5 mm) | Porosity (%) | Resistance to permeation of air (sec/100 ml) | Average of Longitudinal and lateral tensile strength (kg/15 mm) | Average of Longitudinal and lateral modulus (kg/15 mm) | Strike-through (%) |
| Comparative Example | 13 | 1.0 | 10 | 90 | 0 | 14.5 | 6,420 | 2.6 | 98 | 0 |
| Example | 9 | 1.0 | 20 | 80 | 0 | 19.8 | 4,840 | 5.1 | 132 | 0.3 |
| Example | 10 | 1.0 | 50 | 50 | 0 | 24.0 | 1,910 | 5.5 | 144 | 0.5 |
| Comparative | 14 | 1.0 | 80 | 20 | 0 | 62.6 | 1.5 | 3.2 | 100 | 56.1 |

TABLE 2-continued

| Example No. | | Content (wt %) Drawn polyester staple fiber (1.5 d, 5 mm) Flatness | Content (wt %) Drawn polyester staple fiber (1.5 d, 5 mm) Content (wt %) | Content (wt %) Undrawn polyester staple fiber (1.1 d, 5 mm) | Content (wt %) Low melting point polyester staple fiber (4 d, 5 mm) | Paper-like sheet Porosity (%) | Paper-like sheet Resistance to permeation of air (sec/100 ml) | Paper-like sheet Average of Longitudinal and lateral tensile strength (kg/15 mm) | Paper-like sheet Average of Longitudinal and lateral modulus (kg/15 mm) | Paper-like sheet Strike-through (%) |
|---|---|---|---|---|---|---|---|---|---|---|
| Example Comparative | 15 | 1.0 | 90 | 10 | 0 | 79.8 | 0.8 | 0.4 | 52 | 84.0 |
| Example Comparative | 16 | 4.0 | 10 | 90 | 0 | 10.1 | 100,150 | 2.8 | 100 | 0 |
| Example Example | 11 | 4.0 | 20 | 80 | 0 | 15.3 | 39,440 | 5.6 | 150 | 0 |
| Example | 12 | 4.0 | 50 | 50 | 0 | 25.3 | 32,140 | 5.8 | 175 | 0 |
| Example | 13 | 4.0 | 80 | 20 | 0 | 30.3 | 10,120 | 5.0 | 134 | 0 |
| Comparative Example | 17 | 4.0 | 90 | 10 | 0 | 48.2 | 250 | 0.8 | 82 | 1.5 |
| Comparative Example | 18 | 15.0 | 10 | 90 | 0 | 9.9 | 151,200 | 2.5 | 92 | 0 |
| Example | 14 | 15.0 | 20 | 80 | 0 | 15.1 | 83,110 | 6.1 | 161 | 0 |
| Example | 15 | 15.0 | 50 | 50 | 0 | 20.5 | 45,250 | 7.2 | 192 | 0 |
| Example | 16 | 15.0 | 80 | 20 | 0 | 23.1 | 19,800 | 5.9 | 181 | 0 |
| Comparative Example | 19 | 15.0 | 90 | 10 | 0 | 28.9 | 4,100 | 0.6 | 88 | 0.3 |
| Example | 17 | 30.0 | 50 | 50 | 0 | 19.2 | 61,920 | 4.3 | 141 | 0 |
| Example | 18 | 32.0 | 50 | 50 | 0 | 19.2 | 32,180 | 3.7 | 121 | 0 |
| Comparative Example | 20 | 4.0 | 10 | 45 | 45 | 11.3 | 111,290 | 3.1 | 121 | 0 |
| Example | 19 | 4.0 | 20 | 40 | 40 | 15.2 | 39,110 | 5.9 | 188 | 0 |
| Example | 20 | 4.0 | 50 | 25 | 25 | 29.2 | 41,120 | 7.2 | 199 | 0 |
| Example | 21 | 4.0 | 80 | 10 | 10 | 29.9 | 13,250 | 4.9 | 140 | 0 |
| Comparative Example | 21 | 4.0 | 90 | 5 | 5 | 49.3 | 480 | 1.8 | 83 | 1.9 |
| Example | 22 | 4.0 | 20 | 0 | 80 | 14.1 | 44,180 | 7.3 | 200 | 0 |
| Example | 23 | 4.0 | 50 | 0 | 50 | 25.3 | 39,020 | 8.1 | 215 | 0 |
| Example | 24 | 4.0 | 80 | 0 | 20 | 22.9 | 16,550 | 5.7 | 183 | 0 |

In the comparison of Example 9 with Examples 11 and 14, of Example 10 with Examples 12 and 14 and of Comparative Example 14 with Examples 13 and 16, it is clear that the drawn polyester staple fibers having a flat cross-sectional profile are effective for enhancing the resistance of the resultant paper-like sheet to strike-through of the resin emulsion and for increasing the tensile strength and modulus of the paper-like sheet.

From the comparison of Example 17 with Example 18, it is understood that the flatness of more than 30.0 of the drawn polyester staple fibers causes a slight decrease in the tensile strength and modulus of the resultant paper-like sheet.

We claim:

1. A base material for a honeycomb core structure comprising a paper-like polyester fiber sheet which comprises 20% to 80% by weight of drawn polyester staple fibers, the drawn polyester staple fibers having a flat cross-sectional profile with a major axis and a minor axis and 2. The base material as claimed in claim 1, wherein the air permeation resistance of the paper-like polyester fiber sheet is 200 sec/100 ml or more.

3. The base material as claimed in claim 1, wherein the melting point of the low melting point polyester staple fibers is at least 20° C. below that of the undrawn polyester staple fibers.

4. The base material as claimed in claim 1, wherein the undrawn polyester staple fibers have a birefringence of 0.03 or less.

5. The base material as claimed in claim 1, wherein the paper-like polyester fiber sheet has been produced by means of a wet paper-making procedure and then by a heat-pressing procedure.

6. The base material as claimed in claim 5, wherein in the wet paper-making procedure, each of the drawn polyester staple fibers, undrawn polyester staple fibers and low melting point polyester staple fibers has a denier of from 0.01 to 15 and a length of from 1 to 25 mm.

7. The base material as claimed in claim 5, wherein the heat-pressing procedure has been carried out a degree of flatness of from 2.5 to 30.0, the degree of flatness being a ratio of the length of the major axis to the length of the minor axis of the profile, 0 to 80% by weight of undrawn polyester staple fibers, and 0 to 80% by weight of polyester staple fibers having a lower melting point than that of the undrawn polyester staple fibers, the sum of said undrawn and low melting point polyester staple fibers being at least 20% by weight and not more than 80% by weight, and which sheet has a porosity not greater than 60% and a resistance to permeation of air which is an average time in seconds necessary for air to penetrate, in a volume of 100 ml, through the sheet in an area of 78.54 $mm^2$, under a pressure of 721.9 $g/cm^2$, of at least 100 sec/100 ml. by means of a pair of heat-pressing rolls at a roll surface temperature of from 190° C. to 240° C. under a linear pressure of 10 kg/cm or more at a procedure speed of 0.5 m/min or more.

8. A process for producing a base material for a honeycomb core structure comprising suspending 20% to 80% by weight of drawn polyester staple fibers, the drawn polyester staple fibers having a flat cross-sectional profile with a major axis and a minor axis and a degree of flatness of from 2.5 to 30.0, the degree of flatness being a ratio of the length of the major axis to the length of the minor axis of the profile, 0 to 80% by weight of undrawn polyester staple fibers, and 0 to 80% by weight of polyester staple fibers having a lower melting point than that of the undrawn polyester staple fibers in water, the sum of the amounts of the undrawn and low melting point polyester staple fibers being at least 20% by weight and not more than 80% by weight, wherein the percent by weight of fibers is based on the weight of fibers in the suspension;

forming a precursory paper-like sheet from the suspension by means of a wet paper-making method; and heat-pressing the precursory paper-like sheet to an extent such that the heat-pressed paper-like polyester fiber sheet exhibits a porosity not greater than 60% and a resistance to a permeation of air which is an average time in seconds necessary for air to penetrate, in a volume of 100 ml, through the sheet in an area of 78.54 $mm^2$, under a pressure of 721.9 $g/cm^2$, of at least 100 sec/100 ml.

* * * * *